United States Patent [19]

Boliver et al.

[11] 4,090,765

[45] May 23, 1978

[54] ELECTRIC CABLE SEPARABLE CONNECTOR MODULE HAVING A SLIDING SEGMENT GATE GAS-TRAP VALVE

[75] Inventors: Vincent J. Boliver, Hackettstown, N.J.; James E. Belcher, Dalton, Mass.

[73] Assignee: General Electric Company, Philadelphia, Pa.

[21] Appl. No.: 815,183

[22] Filed: Jul. 13, 1977

[51] Int. Cl.[2] ..... H01R 13/52

[52] U.S. Cl. ..... 339/111; 174/73 R

[58] Field of Search ..... 339/111, 43, 112; 174/73 R

[56] References Cited

U.S. PATENT DOCUMENTS 3,763,461 10/1973 Kotski ..... 339/111

*Primary Examiner*—Roy Lake

*Assistant Examiner*—DeWalden W. Jones

*Attorney, Agent, or Firm*—William Freedman; Carl L. Silverman

[57] ABSTRACT

A module of the type having an elongated insulating housing, a contact-receiving bore in the housing, and a bore contact mounted in the housing in communication with the inner end of the bore, for receiving a rod contact of a matching module, is provided with an improved gas-trap valve which comprises a sliding segment gate. The valve is mounted adjacent the outermost end of the bore. It comprises an annular valve casing member having a central opening in alignment with the bore and a chamber in the casing in which the gate segments slide between a pair of parallel and opposed walls in a plane perpendicular to the bore and are biased in a closed position. A depression in the outer faces of the valve segments permits the valve segments to be forced into the open position in response to pressure by a rod contact inserted into the opening.

5 Claims, 4 Drawing Figures

28
30
16
10
18
20
22
24
12

ELECTRIC CABLE SEPARABLE CONNECTOR MODULE HAVING A SLIDING SEGMENT GATE GAS-TRAP VALVE

BACKGROUND OF THE INVENTION

The present invention relates generally to separable connector modules for electrical power cables and relates particularly to a type of module commonly used in high voltage underground electric power distribution systems to connect the cables and operating components of such a system.

Separable connector modules are used in pairs, with one module being a rod module with a contact rod and the other module being a bore module with a receiving bore for the rod of the rod module and with a set of receiving contacts in the bore which firmly grasp the rod to make contact.

Separable connector pairs are frequently disconnected while energized, despite certain arcing hazards which are generally known to be associated with such a loadbreak procedure. One such hazard has to do with the escape from the bore module of ionized conductive gases. A loadbreak disconnection results in arcing between the rod and the receiving contact inside the bore. The arcing causes rapid generation of gases in the bore. The generation of these gases is largely by design, for these gases quench the arcing to permit the disconnection to be completed. However, upon the removal of the rod from the bore, excessive ionized gases inside the module may rush out of the bore and establish a conductive path between the energized contacts and a ground plane, such as the grounded shielding of the cable or connector modules. This would result in a line-to-ground short circuit.

In present connector modules, a hinged-gate gas-trap valve is mounted at the outer end of the bore module to immediately seal shut the bore as soon as the rod is withdrawn, thereby preventing the escape of excessive volumes of ionized gas. Such a device is disclosed and claimed in U.S. Pat. No. 3,763,461 and assigned to the same assignee as this invention.

While that gas-trap valve is effective in preventing escape of the gas, it adds significantly to the longitudinal dimensions of the module. This is a definite disadvantage, since such modules are typically used in close quarters, such as in a distribution transformer cabinet, where the longitudinal dimension is particularly critical. Furthermore, the asymmetrical configuration of the valve, especially the presence of a metal spring to only one side of the valve opening for the hinged gate, can lead to undesirable field stresses at higher voltage ratings, such as at 23.5 kilovolts.

SUMMARY OF THE INVENTION

In accordance with the present invention, a novel connector bore module has mounted adjacent its open end an improved gas-trap valve of the type having a segmented sliding gate.

The improved valve permits a shortening of the longitudinal dimensions of the module and results in a more uniform and symmetrical distribution of the field stress near the end of the module.

DESCRIPTION OF THE PREFERRED EMBODIMENT

Figure 1:
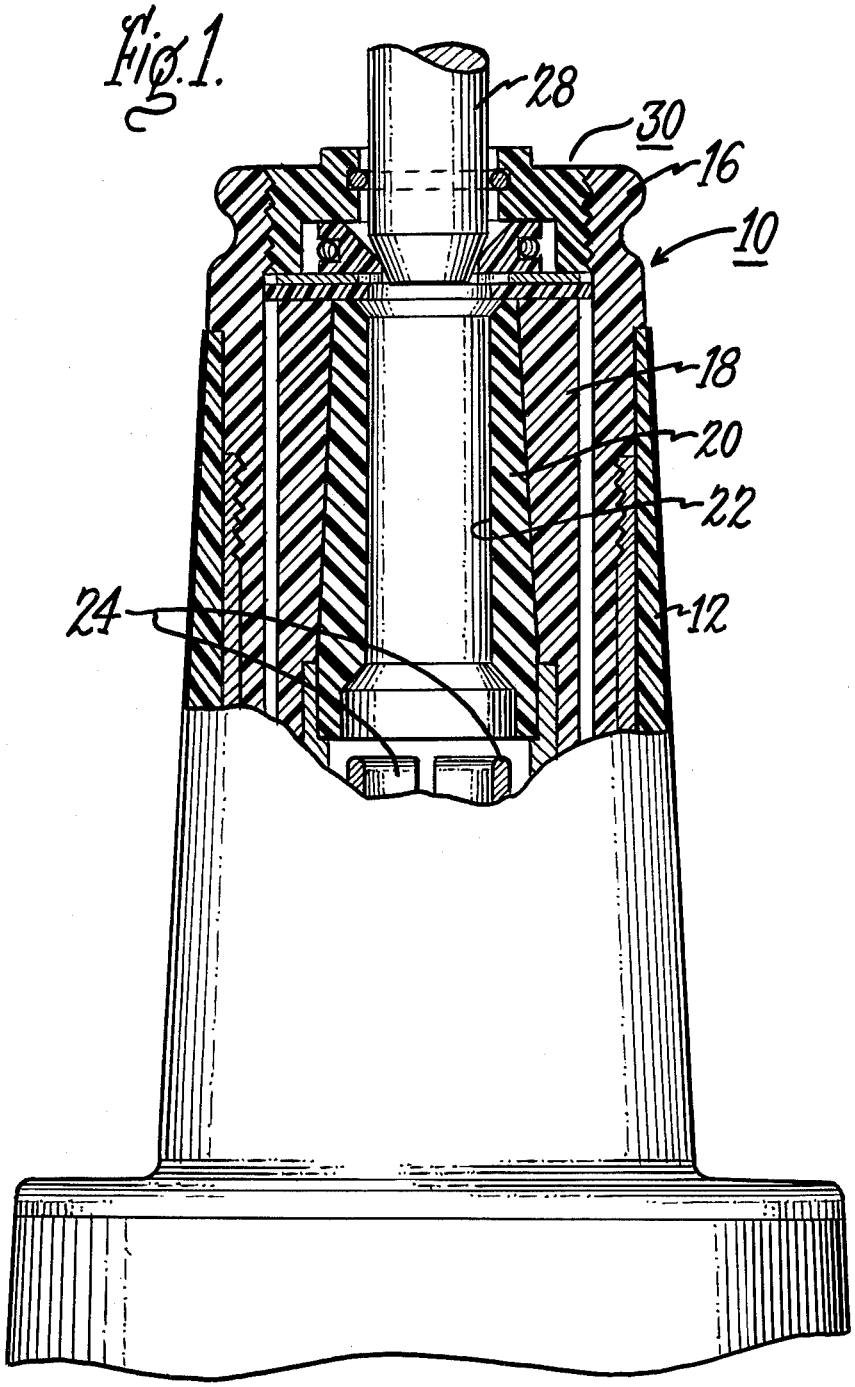
FIG. 1 is a partially sectioned, elevational view of a separable connector switch module having a gas-trap valve in accordance with a preferred embodiment of the present invention.

A preferred embodiment of the gas-trap valve of the present invention is shown as used in the separable connector switch module 10 of FIG. 1. The module 10 is of the type for insertion into a bushing well mounted in a steel transformer housing. Details of the bushing well itself, and of that portion of the module 10 which mates with the well, are not shown in the drawings since they are well known to those of ordinary skill in the art of separable connectors.

Referring now to the FIG. 1, the module 10 includes an insulating, elastomeric housing 12. Mounted in the end of the housing 12 is a thermoplastic insulating nosepiece 16. Mounted inside the housing 12 and extending telescopingly into the nosepiece 16 is an insulating arc snuffer tube 18 which is lined with an ablative snuffer liner 20. The inside surface of the liner 20 defines a bore 22 in the module 10. A female, bore receiving, contact 24 is fixed to the snuffer tube 18 and is in communication with the bore 22, so that it may receive a contact rod (not shown) with follower 28 of a mating connector elbow module, not shown. Only the ablative follower 28 of the mating connector elbow module is shown in the drawings, since the remaining structure is well known to those of ordinary skill in the art of separable connectors. Threaded into the end of the nosepiece 16 is a gas-trap valve 30. The valve 30 is shown in greater detail in the FIGS. 2, 3, and 4.

Figure 2:
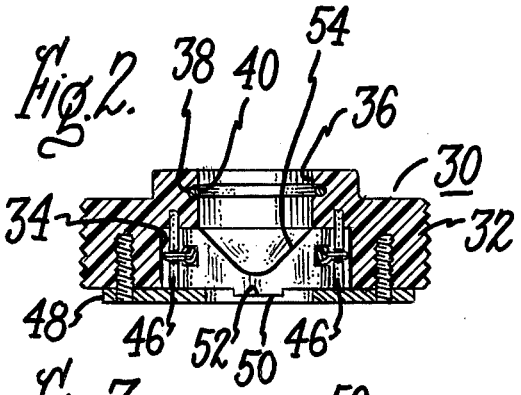
FIG. 2 is a side, sectional view of the preferred gas-trap valve shown in the module of FIG. 1.
Figure 3:
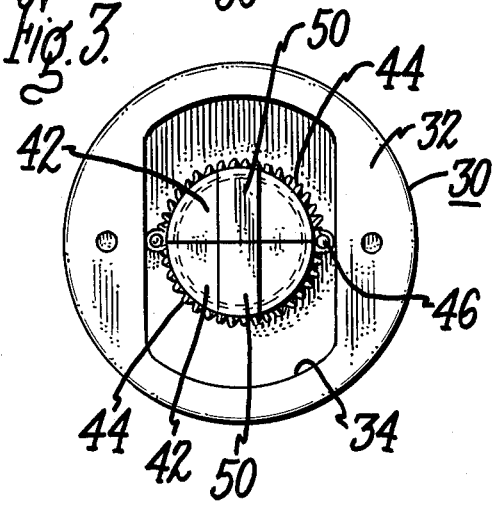
FIG. 3 is a bottom view of the valve of FIG. 2, with the cover plate removed.
Figure 4:
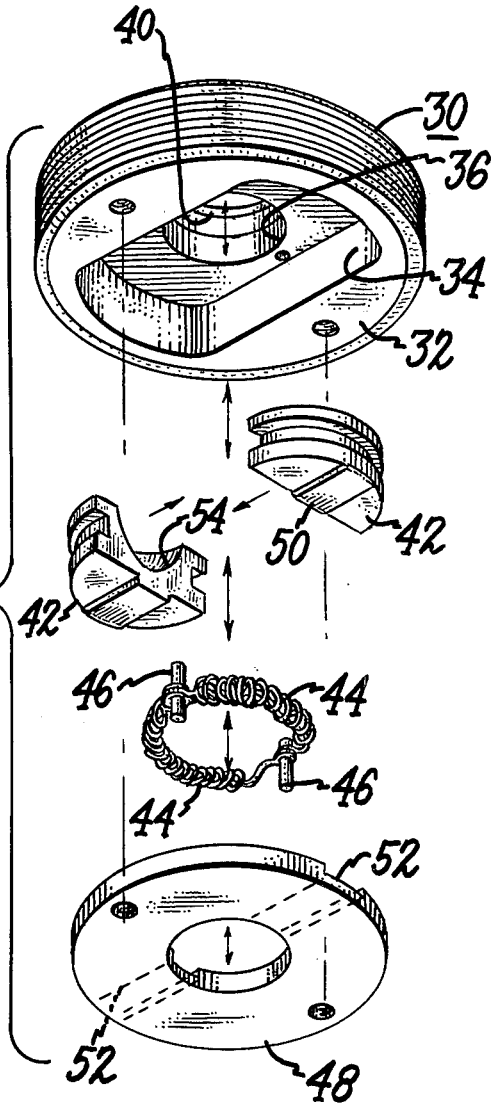
FIG. 4 is an exploded, perspective view of the valve of FIG. 2.

Reference is now made to FIGS. 2, 3, and 4 as a group, and particularly to FIG. 2, which shows the valve 30 in completely assembled form. The valve 30 includes an insulating thermoplastic casing 32 which is threaded about its perimeter for fastening into the matching threads of the nosepiece 16. The casing 32 has a chamber 34 formed in it and also has a central opening 36, which is in alignment with the bore 22 of the module 10 when the valve 30 is installed. Disposed inside the opening 36 is an annular groove 38 containing an O-ring gasket 40 for sealing against the contact rod and follower 28 when it is inserted in the bore 22.

A pair of valve gate segments 42 in the chamber 34 are resiliently biased together below the opening 36 by a pair of garter springs 44 fastened to a pair of anchor posts 46 set into the casing 32. A cover plate 48 constrains the valve gate segments 42 to sliding within the chamber 34 in a plane perpendicular to the bore 22 of the module 10. The segments 42 are provided on their lower faces with keyribs 50 which ride in a matching keyway 52 in the cover plate 48 to prevent rotation of the segments 42 relative to the casing 32.

The exterior faces of the valve gate segments 42 includes depressions 54 which respond to axial pressure from the follower 28 of the mating switch elbow with a lateral force component to force apart the valve segments 42 into the open position.

It is seen that the action of the valve 30 is to check the flow of gas from the module 10 when the contact rod and follower 28 is removed from the bore 22. The valve 30 requires minimal longitudinal dimensions, since no space is needed for longitudinal clearance of any hinged valve gate. Also, the laterally symmetrical configuration of the garter springs 44 provides for a uniform distribution of field stresses in that region.

It should be recognized that more than a pair of segments may make up the valve gate. However, when only two are used, the segments can be more easily supported on the chamber against the back pressure in the module, since they will not be subjected to a cantilever axial force from it over the edge of the opening 36, but will be able to completely bridge the portion of the opening 36 which they cover.

We claim:

1. An electrical power cable separable connector module comprising:

an elongated insulating housing;

means defining an elongated, generally cylindrical, contact-receiving bore that extends from a first end of said housing a predetermined distance into said housing;

a bore contact mounted in said housing in communication with the inner end of said bore, said bore contact being adapted to receive a rod contact member of a matching connector module when the rod contact is inserted into said bore;

a gas-trap valve mounted adjacent the outermost end of said bore, said valve being operable to move rapidly into a closed position thereby to effectively seal the outer end of said bore and trap arc-generated gases therein, responsive to the rod contact being moved outward in said bore beyond said valve, and being further operable to permit entry of said rod contact into said bore when said valve is moved to its open position, the ionized gases being directed against said second contact until they are trapped within said bore by said valve being moved to its closed position, wherein the improvement comprises that said gas trap valve is a segmented sliding gate valve.

2. The connector module defined in claim 1, wherein said valve comprises:

an annular valve casing member removably secured adjacent the first end of said housing;

means defining a central opening in said casing in alignment with said bore of said housing;

a chamber in said casing having first and second parallel and opposed walls lying generally in a plane perpendicular to said bore;

a pair of semicircular valve gate segments having an inner face constrained to slide between said walls;

means for resiliently biasing said gate segments to a closed valve position in which they are together disposed symmetrically over said opening, and a depression surface in the outer faces of said valve segments when in the closed position such that pressure of the rod contact against said depression surface will force said valve segments apart to open said valve.

3. The connector module defined in claim 2 and wherein said means for biasing are garter springs passed about the periphery of each of said gate segments and fastened to said casing.

4. The connector module defined in claim 3 and comprising a resilient gasket in an entrance portion of said opening in said valve casing for forming a seal against the outer surface of the rod contact when the rod contact is inserted into said opening.

5. The connector defined in claim 4 and wherein said valve segments are keyed to at least one of said walls to prevent rotation of said segments relative to said walls.

* * * * *